US006019096A

United States Patent [19]

Snyder et al.

[11] Patent Number: 6,019,096

[45] Date of Patent: Feb. 1, 2000

[54] PORTABLE LIGHTWEIGHT VOLLEY BALL SETTING MACHINE WITH MECHANICAL TIMER

[75] Inventors: Gerard R. Snyder, 7975 Bensville Rd., Waldorf, Md. 20603; Brian Edwards, White Plains, Md.

[73] Assignee: Gerard R. Snyder, Manassas, Va.

[21] Appl. No.: 09/066,854

[22] Filed: Apr. 28, 1998

[51] Int. Cl.[7] ..... F41B 7/00

[52] U.S. Cl. ..... 124/16; 124/33; 124/37

[58] Field of Search ..... 124/16, 26, 33, 124/37

[56] References Cited

U.S. PATENT DOCUMENTS

| | | | |
|---|---|---|---|
| 3,474,771 | 10/1969 | Breslow et al. | 124/16 |
| 4,164,928 | 8/1979 | Meares | 124/16 |
| 5,462,285 | 10/1995 | O'Patka et al. | 124/16 X |
| 5,597,160 | 1/1997 | Mims | 124/16 |
| 5,800,288 | 9/1998 | Mims | 124/16 X |

*Primary Examiner*—John A. Ricci

[57] ABSTRACT

A machine for tossing or set ting a volleyball into the air, to aid in practice of spiking the ball, includes a cylindrical housing with a ball exit opening at one end, with legs to set the housing on the ground with the exit opening facing upward. A ball support cup with attached rod is slidably supported in the housing by a linear bearing. The ball support cup is spring biased toward the exit end; a brake prevents the rod from passing completely through the bearing. The lower end of the rod includes teeth which are engageable with a sprocket wheel of a timer assembly. When a ball is placed on the support cup, and the cup is pushed down, the teeth will engage the sprocket wheel to activate the timer; after a time, the sprocket wheel will disengage from the teeth, allowing the spring to move the support cup upward to launch the ball through the exit opening.

1 Claim, 5 Drawing Sheets

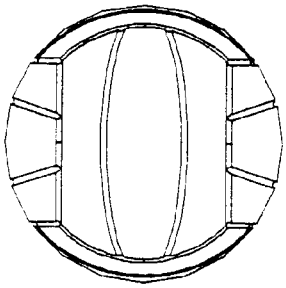
FIG. 5
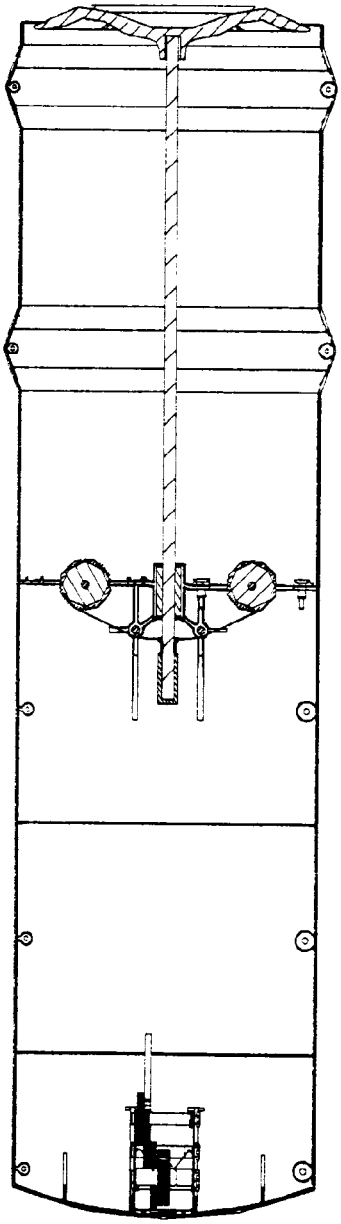

PORTABLE LIGHTWEIGHT VOLLEY BALL SETTING MACHINE WITH MECHANICAL TIMER

BACKGROUND

1. Field of Invention

This invention relates to volleyball, specifically to a portable, lightweight machine that incorporates a mechanical timer and is used to practice volleyball spiking skills by throwing a volleyball into the air.

2. Description of Prior Art

Volleyball is a team sport that requires three basic skills: passing, setting and spiking. A volleyball player must practice these skills often to become proficient. Passing and setting can be done alone; however, spiking requires another person to throw or toss the volleyball into the air so the player can spike it. Several devices have been devised to throw or toss a volleyball. All devices to-date have been large, complicated, heavy, and expensive to manufacture. In addition, most of these devices require electrical power and are not portable.

One such device is shown in U.S. Pat. No. 3,552,371 to Edward W. Kahelin (Jan. 05, 1971). The device is a large assembly consisting of metal braces, support frame, and struts to support a coil spring and throwing arm. This device can not be easily transported to the beach or gymnasium where volleyball practice usually is conducted. Moreover, this device is does not reproduce throw the volleyball in a parabolic trajectory which necessary to simulate the throw/set from a human.

Another device is shown in U.S. Pat. No. 3,605,715 to Dale K. Welborne (Sep. 20, 1971), which uses a coil spring and pivot arm to throw a volleyball in a catapult manner. While this device is portable, is does not provide the ball motion and trajectory necessary to practice spiking a volleyball.

Two other devices have been developed to set a volleyball, and they are shown in U.S. Pat. No. 4,254,755 to Steven R. Morgan and Dwayne E. Reese (Mar. 10, 1981) and U.S. Pat. No. 4,714,069 to Harold C. Ulrich (Dec. 22, 1987). Each of these devices requires electric power and is not easily transported. They are heavy, complicated, and expensive to manufacture.

OBJECTS AND ADVANTAGES

Accordingly, several objects and advantages of our invention are to provide a volleyball setting machine that is portable, lightweight and easily transported by one person, which requires no electrical or battery power, which throws/sets a volleyball in such a manner that produces the motion and trajectory of that produced by a human, which is easily operated by most persons without tools or support equipment, which provides a delay time for the user to retreat to a spiking position, and which is simple, low cost and easily manufactured.

Still further objects and advantages will become apparent from a consideration of the ensuing description and accompanying drawings.

BRIEF DESCRIPTION OF THE DRAWINGS

FIG. 5 is a cutaway view with the volleyball after it has been set.

REFERENCE NUMERALS

| | |
|---|---|
| 10 | Housing |
| 12 | Mechanical Timer Subassembly |
| 14 | #6 Sheet Metal Screws |
| 16 | Ballcup |
| 18 | Nylon Linear Bearing |
| 20 | Fiberglass Rod |
| 22 | Steel Rivet |
| 24 | Roller |
| 26 | Constant-Force Coil Spring |
| 28 | Steel Rod |
| 30 | Rack Square |
| 32 | #10 Screws |
| 36 | Knob Screws |
| 38 | Braking Alignment Pins |
| 40 | Assembly Hole |
| 42 | Assembly Post |
| 44 | Timer Frame |
| 46 | Sprocket Gears |
| 50 | Gear Pins |
| 52 | Star Gear |
| 54 | Rocker |
| 56 | Legs |
| 58 | Plastic Rivets |

SUMMARY

A portable, lightweight volleyball setting machine with mechanical timer comprising: a housing; constant-force coil springs being mounted to the housing and attached to a fiberglass rod using a steel rivet; a ballcup and rack square attached to the fiberglass rod; a mechanical timer comprised of a timer frame, sprocket gears, a start gear and rocker; alignment braking pins; and adjustable legs attached to the housing.

PREFERRED EMBODIMENT—DESCRIPTION

Figure 1:
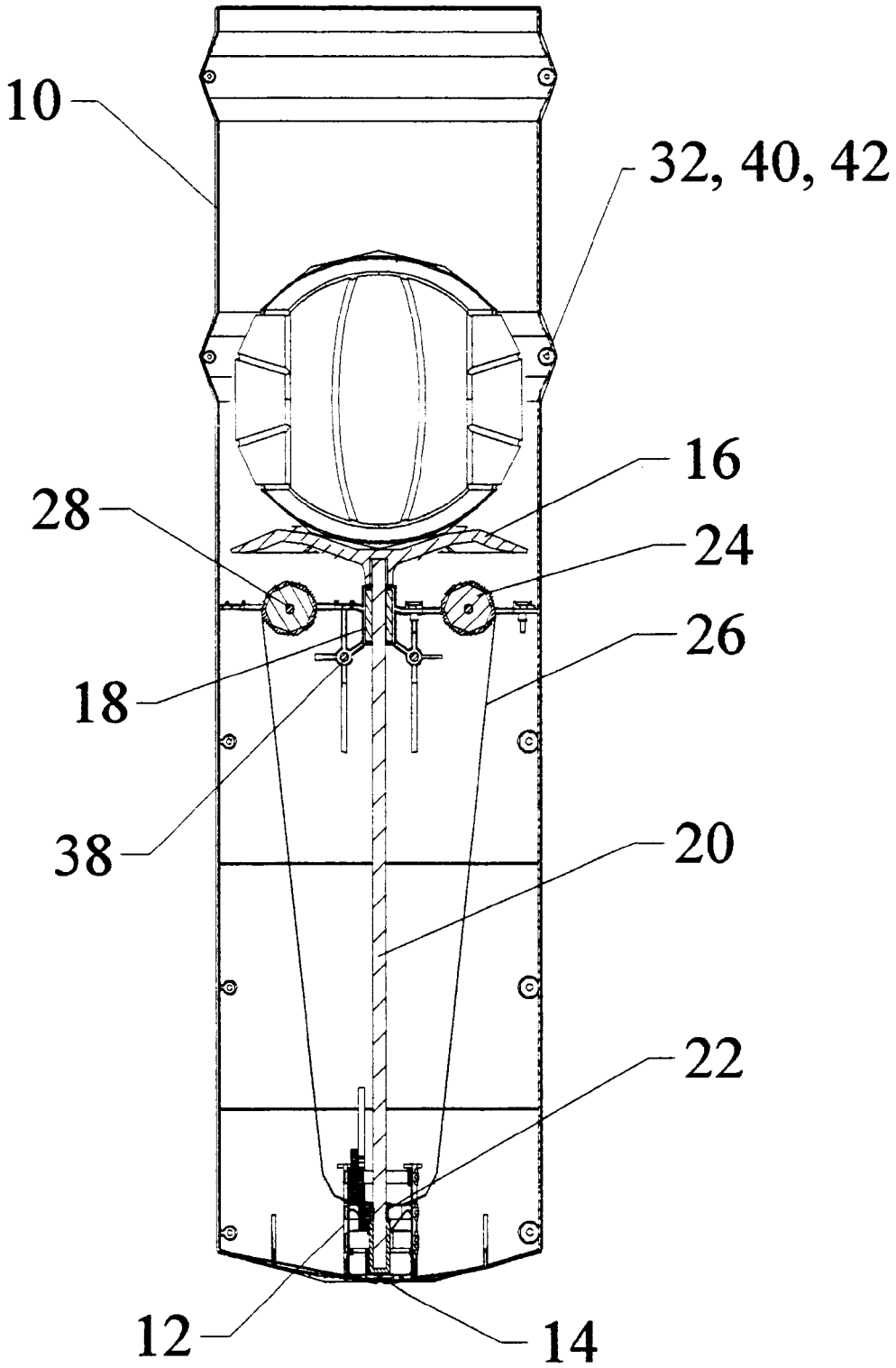
FIG. 1 shows a cutaway view of the Portable, Lightweight Volleyball Setting Machine with Mechanical Timer and all the principal components when it is in the loaded position.

FIG. 1 shows a cutaway view of a portable, lightweight volleyball setting machine with mechanical timer. The Housing 10 is comprised of two identical sections fabricated using injection molded polypropylene, which is strong and lightweight. A Mechanical Timer Subassembly 12 (see FIG. 2 for a more detailed view) is attached to the Housing 10 as shown with four #6 Sheet Metal Screws 14. A polyvinyl chloride Roller 24 is inserted into each of Constant-Force Coil Spring 26. A Steel Rod 28 is inserted through a hole in each Roller 24. The end of each Constant-Force Coil Spring 26 has a hole that is placed over the Steel Rivet 22. The Steel Rivet 22 is inserted approximately 1 inch from one end of Fiberglass Rod 20 and crimped to permanently attach the Constant-Force Coil Springs 26 to the Fiberglass Rod 20. The Rack Square 30 is made of injection molded nylon and is fixed to Fiberglass Rod 20 (also shown in FIG. 2) using a plastic adhesive. The Nylon Linear Bearing 18 is assembled into one half of the Housing 10, and the Fiberglass Rod 20 is inserted through the Nylon Linear Bearing 18. The Constant-Force Coil Springs 26, Rollers 24, and Steel Rods 28 (see FIG. 3 for more detail) are assembled into the Housing 10. The Ballcup 16 is attached to the Fiberglass Rod 20 using plastic adhesive. Each half of the Housing 10 is oriented properly using two Braking Alignment Pins 38, and secured together using ten #10 Screws 32. Each of the ten #10 Screws 32 are inserted through Assembly Hole 40 and threaded into Assembly Post 42.

Figure 2:
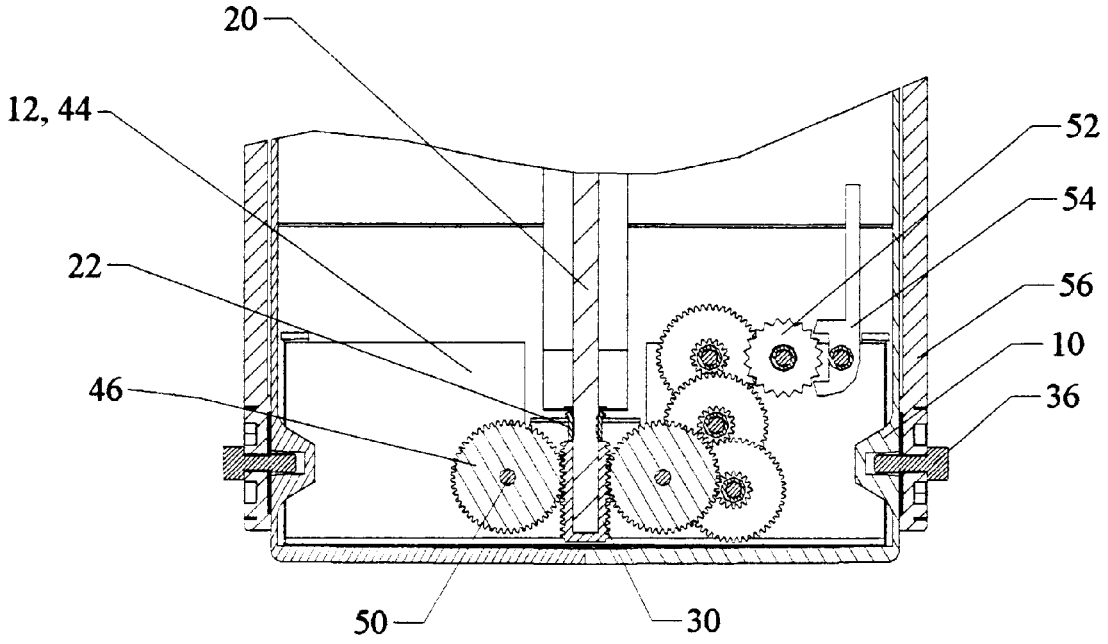
FIG. 2 is an expanded view of the mechanical timer subassembly.

FIG. 2 shows a detailed view of the Mechanical Timer Subassembly 12. The Mechanical Timer Subassembly 12 utilizes a metal Timer Frame 44 to mount Sprocket Gears 46 using Gear Pins 50. The Star Gear 52 interfaces with the Sprocket Gears 46 and Rocker 54. Also shown in FIG. 2 are two Legs 56 that are attached to the Housing 10 using Knob Screws 36.

Figure 3:
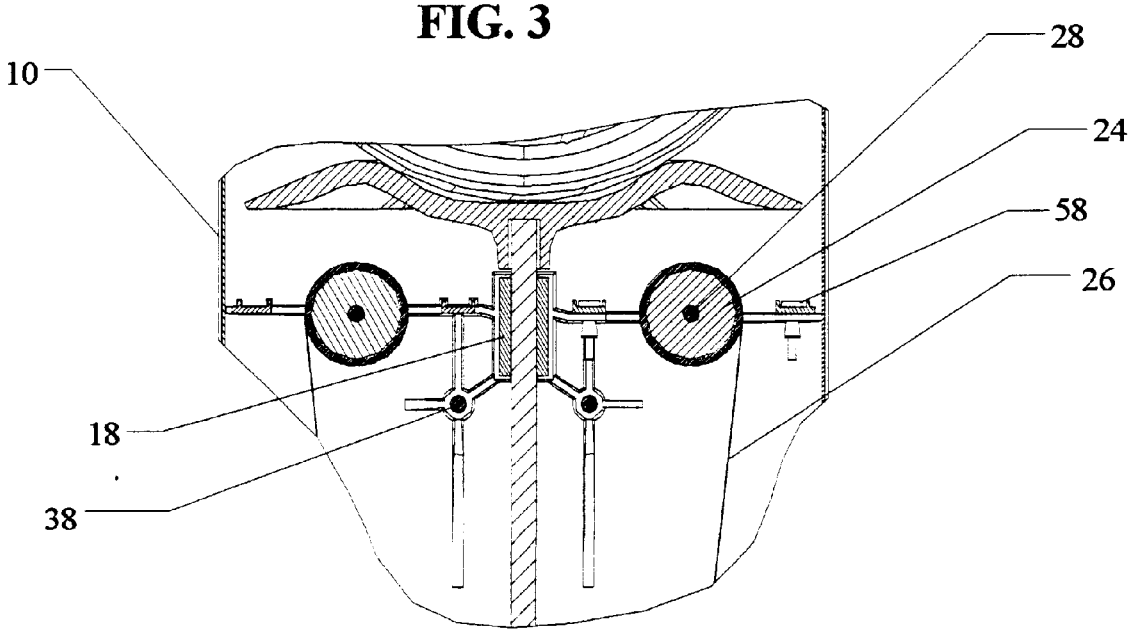
FIG. 3 shows an expanded view of the constant force springs, rollers, steel pins, and braking alignment pins.

FIG. 3 shows a detailed view of the Roller 24, Steel Rod 28, and Constant-Force Coil Spring 26. Two of the four Plastic Rivets 58 are shown inserted into holes of the matching halves of the Housing 10. FIG. 3 also shows a more detailed view of the Nylon Linear Bearing 18 and the Braking Alignment Pins 38, which is secured between each half of the Housing 10.

Figure 4:
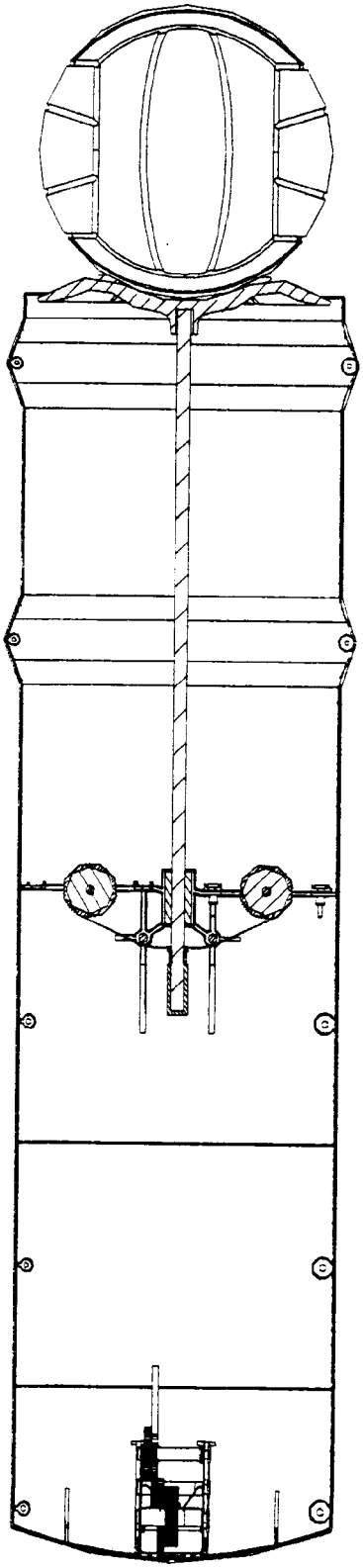
FIG. 4 is a cutaway view in the release position.

FIGS. 4 and 5 show additional cutaways views of the portable, lightweight volleyball setting machine.

Figure 6:
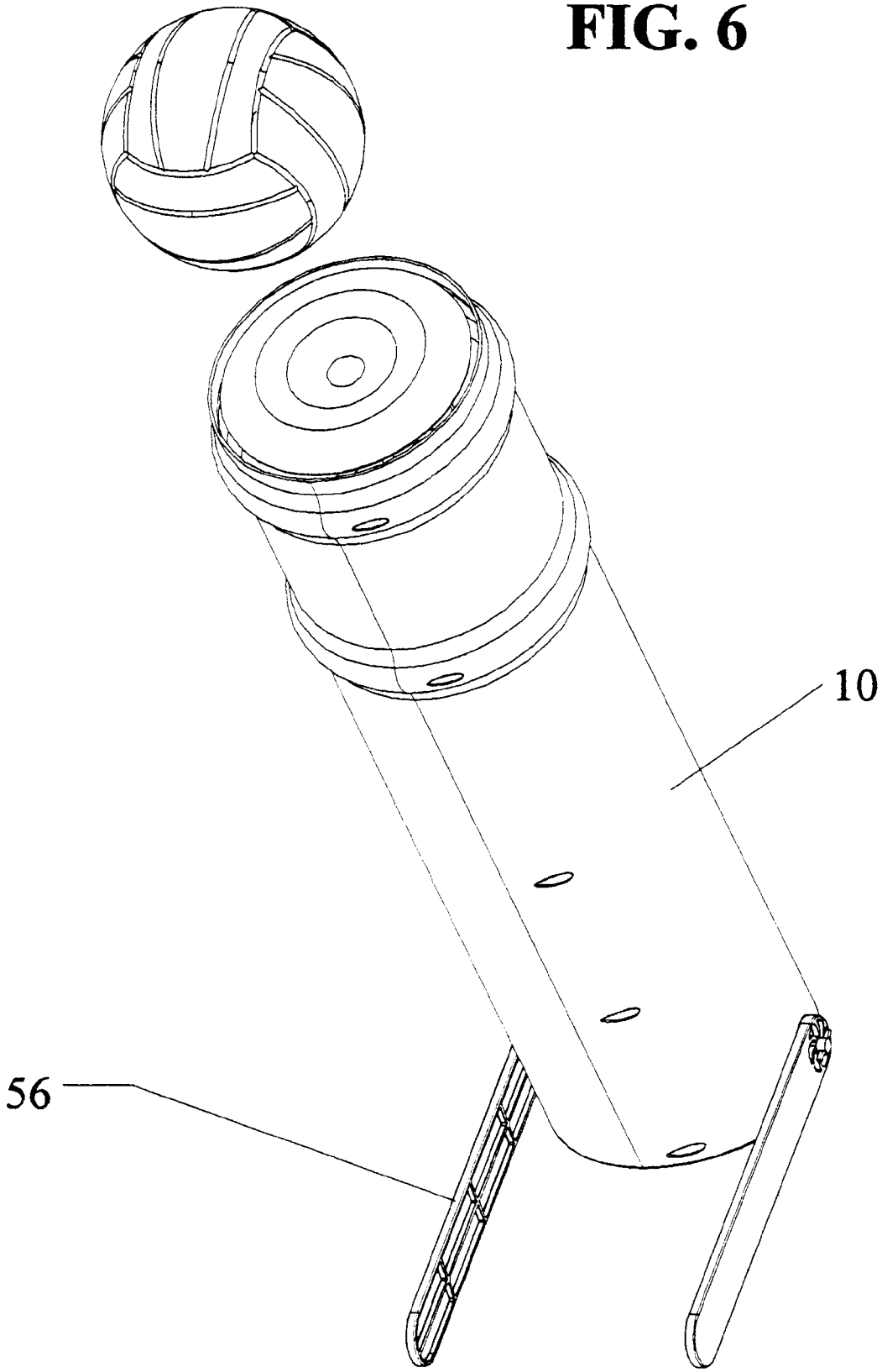
FIG. 6 is an external view of the Portable, Lightweight Volleyball Setting Machine with Mechanical Timer.

FIG. 6 shows and external, isometric view showing the Legs 56 attached to the Housing 10.

PREFERRED EMBODIMENT—OPERATION

The invention works as follows: The user selects the desired trajectory of the volleyball by loosing the Knob Screws 36, rotating each of the Legs 56 to the selected angle, and re-tightening the Knob Screws 36. The operator places a volleyball onto the Ballcup 16 and depresses it. By depressing the Ballcup 16, the Fiberglass Rod 20 and Rack Square 30 are forced downward stretching each Constant-Force Coil Spring 26. As the Rack Square 30 reaches the bottom of the Housing 10, the Rack Square 30 engages two of the Sprocket Gears 46 assembled into the Timer Frame 44. The downward motion moves one of the Sprocket Gears 46 that disengages from the Star Gear 52. This allows the Rack Square 30 to move without resistance directly to bottom dead center. When the user releases pressure from the volleyball, the upward force produced by the Constant-Force Coil Springs 26 re-engages the Sprocket Gears 46 with Star Gear 52 and begins to rotate. The Rocker 54 controls the rotational speed of the Star Gear 52 by indexing each tooth, allowing rotation of the Sprocket Gears 46 at a constant rate. The rotation of the Sprocket Gears 46 allows controlled upward motion of the Rack Square 30. After approximately 12 seconds, the Rack Square 30 is released from the Sprocket Gears 46 and travels upward. The Braking Alignment Pins 38 absorb the shock of the Constant-Force Coil Springs 26, and the Ballcup 16, Fiberglass Rod 20, and Rack Square 30 come to a stop. The momentum of the volleyball results in a parabolic trajectory.

CONCLUSIONS, RAMIFICATIONS, AND SCOPE

Accordingly, it can be seen that the Portable, Lightweight Volleyball Setter with Mechanical Timer provides a completely unique method for propelling a volleyball. The device provides consistent, repeatable sets with little or no spin—effectively simulating a human. It requires no electrical power and is easily operated. The use of constant-force coil springs eliminates the need for any complex mechanical devices. The adjustable legs allow the user to select the desired trajectory. The mechanical timer provides a simple method allowing the user to retreat to their approach or hitting location. Finally, the device has been designed to be simple and easily manufactured using low-cost, plastic injection molded parts.

Although the description above contains many specifics, these should not be construed as limiting the scope of the invention but as merely providing illustrations of some of the presently preferred embodiments of this invention. Various other embodiments and ramifications are possible within it's scope. For example, the Housing 10 design can be altered slightly to throw other types of balls such as a soccer ball or several balls by incorporating a hopper. The height at which the bail can be tossed can be varied by changing the Constant-Force Coil Springs 26, modifying the Ballcup 16, or changing the length of the Rack Square 30. Additionally, the Rocker 54 can be altered to vary the delay time.

Thus, the scope of the invention should be determined by the appended claims and their legal equivalents, rather than by the examples given.

What is claimed is:

1. A device for tossing a ball into the air, comprising:

(a) a housing including a ball exit opening at one end, and legs which allow the housing to be disposed on a surface at a desired angle;

(b) a linear bearing mounted within the housing;

(c) a ballcup having a surface for supporting and tossing a ball, the ballcup including a rod depending therefrom, the rod slidably disposed through the linear bearing, such that the ballcup and rod are slidable within the housing toward and away from the ball exit opening between an uncocked position and a cocked position;

(d) a brake to prevent the rod from passing completely through the bearing when in the uncocked position;

(e) a spring assembly to bias the ballcup and rod toward the uncocked position;

(f) the rod including, at an end remote from the ballcup, a rack of teeth which is engageable with a timer assembly;

(g) the timer assembly including at least one sprocket gear engageable with the rack, the timer assembly allowing the at least one sprocket gear to rotate freely and engage the rack when the ballcup and rod are pushed toward the cocked position, the timer assembly allowing slow, timed motion of the rack toward the uncocked position, such that, after the ballcup and rod are pushed toward the cocked position and a ball placed on the ballcup, the rack will slowly advance toward the uncocked position until the rack becomes disengaged from the at least one sprocket gear, at which time the spring assembly will rapidly advance the ballcup and rod toward the uncocked position until the rod is stopped by the brake, and the ball will be tossed through the exit opening.

* * * * *